US011058164B2

(12) United States Patent
Mustapha

(10) Patent No.: US 11,058,164 B2
(45) Date of Patent: Jul. 13, 2021

(54) MAGNETIC CUSHION TECHNOLOGY

(71) Applicant: Sulaiman Mustapha, Sylvania, OH (US)

(72) Inventor: Sulaiman Mustapha, Sylvania, OH (US)

( * ) Notice: Subject to any disclaimer, the term of this patent is extended or adjusted under 35 U.S.C. 154(b) by 0 days.

(21) Appl. No.: 16/380,783

(22) Filed: Apr. 10, 2019

(65) Prior Publication Data

US 2020/0037691 A1 Feb. 6, 2020

Related U.S. Application Data

(63) Continuation of application No. 13/540,582, filed on Jul. 2, 2012, now abandoned.

(51) Int. Cl.
*A42B 3/06* (2006.01)
*H01F 7/02* (2006.01)

(52) U.S. Cl.
CPC ..... *A42B 3/064* (2013.01); *H01F 7/02* (2013.01)

(58) Field of Classification Search
CPC .. A42B 3/06; A42B 3/12; A42B 3/125; A42B 3/064; H01F 7/02
See application file for complete search history.

(56) References Cited

U.S. PATENT DOCUMENTS 5,233,768 A * 8/1993 Humphreys ..... A43B 1/0054 36/140
7,213,350 B2 * 5/2007 Brown ..... A43B 1/0018 36/12
8,015,624 B2 * 9/2011 Baldackin ..... A42B 3/124 2/412
9,545,125 B2 * 1/2017 Yoon ..... A41D 13/015
2008/0086916 A1 * 4/2008 Ellis ..... A43B 13/141 36/103
2009/0098802 A1 * 4/2009 Talamo ..... A41C 3/144 450/38
2010/0263110 A1 * 10/2010 Berry ..... A41D 13/0512 2/459
2010/0275347 A1 * 11/2010 Baldackin ..... A42B 3/065 2/411
2012/0000008 A1 * 1/2012 Baldackin ..... A42B 3/124 2/410
2013/0125294 A1 * 5/2013 Ferrara ..... A42B 3/064 2/411
2014/0215693 A1 * 8/2014 O'Gara ..... A42B 3/069 2/410
2014/0259308 A1 * 9/2014 Moss ..... A42B 3/0406 2/410
2014/0283286 A1 * 9/2014 Yoon ..... A42B 3/06 2/411

* cited by examiner

*Primary Examiner* — Sally Haden
(74) *Attorney, Agent, or Firm* — Fay Sharpe LLP

(57) ABSTRACT

A cushion, using magnetic friction as base protection is specifically tested and designed for use in helmets to minimize the risk of concussions. The cushion can be used in a two layer helmet where the magnets are used to repel the impact normally taken straight to the head. The magnets can be placed in between the layers to not only take the impact, but also give that force back towards the source, creating a cushion like no other helmet. With this two-layer system, one can measure that the first layer of magnets takes the hit and uses the second layer to push back off of. This movement that the helmet takes significantly improves protection of the brain as compared to conventional helmets.

15 Claims, 1 Drawing Sheet

MAGNETIC CUSHION TECHNOLOGY

BACKGROUND OF THE INVENTION

The present invention relates to helmet and helmet accessories and, more particularly, to a magnetic dampening system for helmets that uses magnetic friction as base protection.

Concussions are a large issue in sports today. In fact, 3.8 million Americans get concussions every year. Concussions can cause a mental dysfunction or even post-concussion syndrome. These horrible after effects can ruin the rest of one's life ahead of them.

Conventional helmets are well-built and do what they can to give all of the advantage to the cushions they use, which is typically an EPP foam. One issue with conventional helmets is not the lack of cushion, but the goal of the helmet. With conventional helmets, one gets excellent skull protection, but does not provide adequate protection against getting a concussion. An impact, with most conventional helmets, simply travels through the helmet, onto the skull, and onto the brain, causing concussions. These convention helmets do little to take the hit before the head and brain does.

As can be seen, there is a need for an improved helmet and helmet cushioning system that dampen impacts before they can reach the user's brain and cause concussions.

SUMMARY OF THE INVENTION

In one aspect of the present invention, a magnetic dampening system comprises an inner member having one or more inner magnets disposed on an outer surface of the inner member; an outer member having one or more outer magnets disposed on an inner surface of the outer member; and alignment bars configured to align the inner member and the outer member such that the one or more inner magnets are disposed adjacent to the one or more outer magnets, wherein faces of the one or more inner magnets and the one or more outer magnets that face each other are of the same magnetic pole.

In another aspect of the present invention, a helmet comprises an inner shell having one or more inner magnets disposed on an outer surface of the inner shell; interior padding on an inner surface of the inner shell; an outer shell having one or more outer magnets disposed on an inner surface of the outer shell; and alignment bars configured to align the inner shell and the outer shell such that the one or more inner magnets are disposed adjacent to the one or more outer magnets, wherein faces of the one or more inner magnets and the one or more outer magnets that face each other are of the same magnetic pole.

In a further aspect of the present invention, a method for absorbing an impact comprises disposing one or more inner magnets on an outer surface of an inner member; disposing one or more outer magnets an inner surface of an outer member; and aligning the inner member and the outer member such that the one or more inner magnets are disposed adjacent to the one or more outer magnets; generating a repelling force between faces of the one or more inner magnets and the one or more outer magnets to help absorb and push back against the impact.

These and other features, aspects and advantages of the present invention will become better understood with reference to the following drawings, description and claims.

DETAILED DESCRIPTION OF THE INVENTION

Figure 1:
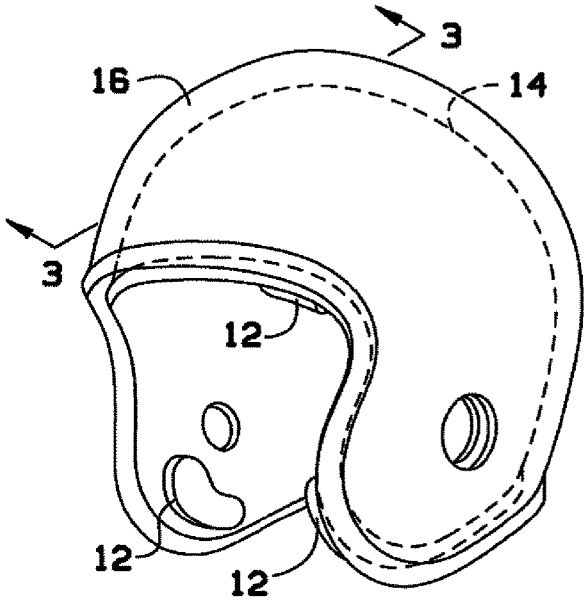
FIG. 1 is a perspective view of a helmet including a magnetic dampening system according to an exemplary embodiment of the present invention.
Figure 3:
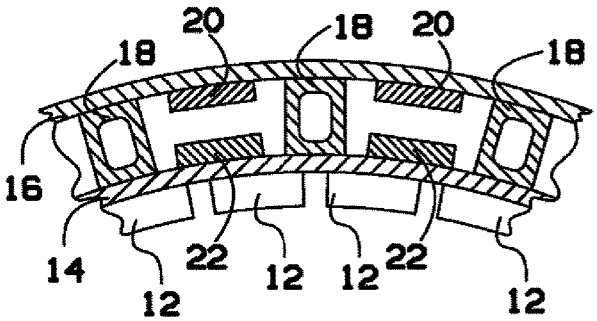
FIG. 3 is a cross-sectional view taken along line 3-3 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a cushion, using magnetic friction as base protection that is specifically tested and designed for use in helmets to minimize the risk of concussions. The cushion can be used in a two layer helmet where the magnets are used to repel the impact normally taken straight to the head. The magnets can be placed in between the layers to not only take the impact, but also give that force back towards the source, creating a cushion like no other helmet. With this two-layer system, one can measure that the first layer of magnets takes the hit and uses the second layer to push back off of. This movement that the helmet takes significantly improves protection of the brain as compared to conventional helmets.

Referring now to FIGS. 1 through 4, a helmet includes an inner shell 14 shaped to fit about a wearer's head. Interior padding 12 can be provided along an inside surface of the inner shell 14 to be disposed between the inner shell 14 and the wearer's head.

A plurality of inner magnets 22 can be disposed along an outer surface of the inner shell 14. The inner magnets 22 can be any number of discrete magnets or may be one or more sheet magnets, for example. The inner magnets 22 can be provided in various forms, sizes, types and the like. The inner magnets 22 can be injected, compressed and magnetized on the line during the manufacture of the helmet. In some embodiments, the inner magnets 22 may be permanent magnets disposed onto the outer surface of the inner shell 14 during manufacture thereof. The inner magnets 22 can be disposed in the helmet to maximize protection for the user. For example, in some embodiments, the inner magnets 22 can be concentrated in major contact positions, such as the top, front, sides, back and jaws of the helmet. Of course, while the drawings show a particular magnet configuration, various magnet configurations can be used within the layers of the helmet, depending upon the intended application.

A column alignment system can include a plurality of bars 18 that extend from the outside of the inner shell 14 to the inside of the outer shell 16. The bars 18 may be silicone bars that keep the helmet in line but also giving the helmet the freedom to take a hit. The silicone bars 18 can be formed as a gel-like silicone that can collapse upon receiving an impact. In some embodiments the inside of the outer shell 16 and the outside of the inner shell 14 may include pockets for disposing the bars 18 so that, when the inner and outer shells 14, 16 are placed together, the bars 18 maintain alignment of the inner and outer shells 14, 16. Other mechanisms may also be used to fix the relative positions of the inner and outer shells 14, 16 when the helmet is used.

Figure 4:
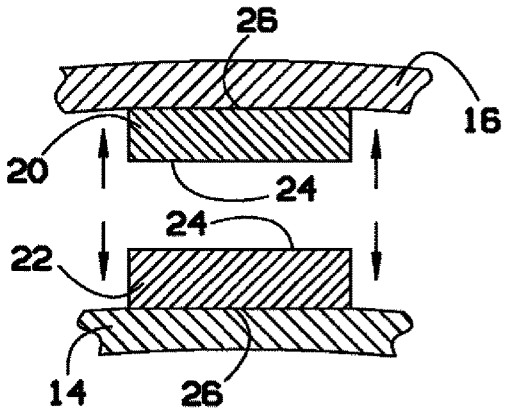
FIG. 4 is a detailed sectional view showing magnetic interactions in the helmet of FIG. 1.
Figure 2:
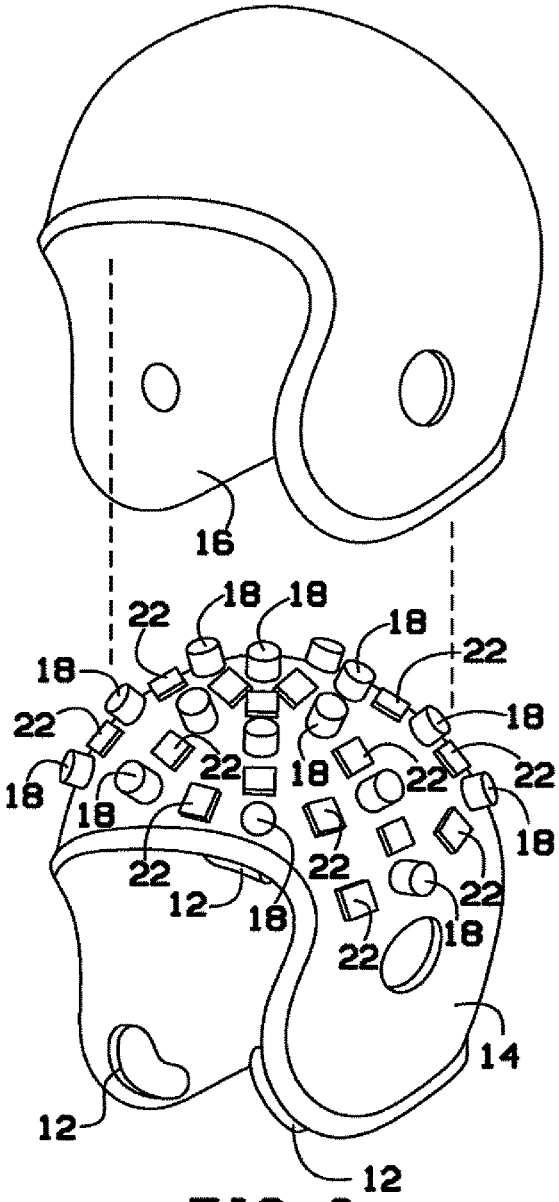
FIG. 2 is an exploded perspective view of the helmet of FIG. 1.

A plurality of outer magnets 20 may be disposed on an inside surface of the outer shell 16. The outer magnets 20 may align with the inner magnets 22 to provide a magnetically repelling force therebetween. For example, as shown in FIG. 4, north magnetic poles 24 of the inner and outer magnets 22, 20 may be directed toward each other, while south magnetic poles 26 may be directed toward the respective inner and outer shells 14, 16. Of course, the opposite configuration may be used, with south magnetic poles 26 of the inner and outer magnets 22, 20 disposed facing each other.

The helmet of the present invention can be made from various materials. For example, the inner and outer shells 14, 16 may be made from plastic, composite, carbon fibers, mixtures thereof, or the like. The outer surface of the outer layer can be enclosed and fashioned as desired. While the bars 18 have been described as silicone bars above, other materials may be used, provided they are resilient enough to allow the magnets 20, 22 to come closer to each other.

While the above description has focused on a magnetic dampening system for helmets, the system of the present invention may be used for various other items, such as beds, shoes, chairs, or the like. Virtually any item that has a cushion could be switched out with the magnetic cushion technology of the present invention.

It should be understood, of course, that the foregoing relates to exemplary embodiments of the invention and that modifications may be made without departing from the spirit and scope of the invention as set forth in the following claims.

What is claimed is:

1. A magnetic dampening system for a helmet dimensioned for receipt on an associated wearer's head comprising:

a first, substantially hemispherical inner shell having a first, outer surface and a second, inner surface, the inner surface of the hemispherical inner shell forming a first cavity dimensioned for receipt on the associated wearer's head, the hemispherical inner shell including a perimeter edge;

a second, substantially hemispherical outer shell having a first, inner surface and a second, outer surface, the inner surface of the hemispherical outer shell forming a second cavity dimensioned and that receives the hemispherical inner shell therein, and the hemispherical outer shell including a perimeter edge, the hemispherical outer shell received over and co-terminous with the hemispherical inner shell such that the inner surface of the hemispherical outer shell is dimensioned to be in spaced relation with the outer surface of the hemispherical inner shell when the perimeter edges of the hemispherical inner shell and the hemispherical outer shell are aligned;

a magnetic dampening system includes at least one inner magnet disposed on the outer surface of the hemispherical inner shell;

at least one outer magnet disposed on the inner surface of the hemispherical outer shell, the outer magnet disposed in spaced relation on the inner surface of the hemispherical outer shell, a magnetic pole of the at least one outer magnet is oriented relative to a magnetic pole of the at least one inner magnet so that the at least one inner magnet and the at least one outer magnet repel so that an impact imposed on the hemispherical outer shell is dampened on the hemispherical inner shell via the magnets, and the outer magnet is aligned with the inner magnet when the hemispherical inner shell is disposed in the hemispherical outer shell in co-terminous relation; and an alignment assembly that extends from and joins the hemispherical inner shell to the hemispherical outer shell and maintains the hemispherical inner and hemispherical outer shells in aligned relation, and the alignment assembly maintains the a pole of the inner magnet in aligned, facing disposition with the like pole of the outer magnet and thereby provide a magnetically repelling force therebetween.

2. The magnetic dampening system of claim 1, wherein the hemispherical inner shell and the hemispherical outer shell form the helmet.

3. The magnetic dampening system of claim 2, further comprising interior padding on the second, inner surface of the hemispherical inner shell.

4. The magnetic dampening system of claim 1, wherein the alignment assembly includes bars that are silicone.

5. The magnetic dampening system of claim 1, wherein the at least one inner magnet includes a plurality of discrete inner magnets disposed on the outer surface of the hemispherical inner shell and the at least one outer magnet includes a plurality of discrete outer magnets disposed on the inner surface of the hemispherical outer shell.

6. The helmet of claim 1 wherein the alignment assembly is formed from a resilient material that can collapse in response to an impact force imposed thereon.

7. The helmet of claim 6 wherein the resilient material is a silicone.

8. The helmet of claim 7 wherein the resilient material has a hollow interior.

9. The helmet of claim 6 wherein the resilient material has a hollow interior.

10. A helmet dimensioned for receipt on an associated wearer's head comprising:

a first, substantially hemispherical inner shell having a first, outer surface and a second, inner surface, the second, inner surface of the hemispherical inner shell forming a first cavity dimensioned for receipt on the associated wearer's head, the hemispherical inner shell including a perimeter edge;

interior padding on an inner surface of the hemispherical inner shell;

a second, substantially hemispherical outer shell having a first, outer surface and a second, inner surface, the second, inner surface of the hemispherical outer shell forming a second cavity dimensioned and that receives the hemispherical inner shell therein, and the hemispherical outer shell including a perimeter edge, the hemispherical outer shell received over and co-terminous with the hemispherical inner shell such that the second, inner surface of the hemispherical outer shell is dimensioned to be in spaced relation with the first, outer surface of the hemispherical inner shell when the perimeter edges of the hemispherical inner shell and the hemispherical outer shell are aligned;

a magnetic dampening system includes at least one inner magnet disposed in spaced relation on the first, outer surface of the hemispherical inner shell;

at least one outer magnet disposed on the second, inner surface of the hemispherical outer shell, the at least one outer magnet disposed in spaced relation on the second, inner surface of the hemispherical outer shell, the at least one outer magnet aligned with the at least one inner magnet when the hemispherical inner shell is disposed in the hemispherical outer shell in co-terminous relation, the at least one inner magnet and the at least one outer magnet repel so that an impact imposed on the hemispherical outer shell is dampened on the hemispherical inner shell via the magnets; and an alignment assembly that extends from and joins the hemispherical inner shell to the hemispherical outer shell and maintains the hemispherical inner and outer shells in fixed aligned relation, and alignment assembly also maintains the at least one inner magnet having a magnetic pole facing a like, magnetic pole of the at least one outer magnet, and thereby provide a magnetically repelling force therebetween.

11. The helmet of claim 10, wherein the at least one inner magnet includes a plurality of discrete inner magnets disposed on the first, outer surface of the hemispherical inner shell and the at least one outer magnet includes a plurality of discrete outer magnets disposed on the inner surface of the hemispherical outer shell.

12. The helmet of claim 10 wherein the alignment assembly is formed from a resilient material that can collapse in response to an impact force imposed thereon.

13. The helmet of claim 12 wherein the resilient material is a silicone.

14. The helmet of claim 13 wherein the resilient material has a hollow interior.

15. The helmet of claim 12 wherein the resilient material has a hollow interior.

* * * * *